United States Patent [19]

Obenshain

[11] Patent Number: 4,960,255

[45] Date of Patent: Oct. 2, 1990

[54] SPRING SUPPORTED MAILBOX POST

[75] Inventor: James R. Obenshain, Peebles, Ohio

[73] Assignee: The Cedar Works, Inc., Peebles, Ohio

[21] Appl. No.: 408,807

[22] Filed: Sep. 18, 1989

[51] Int. Cl.[5] ..... A45F 3/44

[52] U.S. Cl. ..... 248/156; 52/157; 248/149

[58] Field of Search ..... 405/244, 232; 40/607, 40/608; 52/157; 248/149, 156; 232/17, 39

[56] References Cited

U.S. PATENT DOCUMENTS

| | | | |
|---|---|---|---|
| D. 262,409 | 12/1981 | Antonacci . | |
| 289,033 | 11/1883 | Shattuck . | |
| 399,202 | 3/1889 | Mesker et al. | 52/731 |
| 742,549 | 10/1903 | Zeh et al. | 52/731 |
| 903,242 | 11/1908 | Thayer . | |
| 1,013,410 | 1/1912 | Lynch . | |
| 1,435,363 | 11/1922 | Wood | 40/608 |
| 1,599,066 | 9/1926 | Rushmore . | |
| 1,939,968 | 8/1930 | Frei, Jr . | |
| 2,032,922 | 3/1936 | Driver | 52/731 |
| 2,103,410 | 3/1936 | Frei, Jr. . | |
| 2,121,379 | 6/1938 | Young | 40/608 X |
| 3,193,230 | 8/1963 | Crankshaw . | |
| 3,216,170 | 11/1965 | Deadrick | 52/731 |
| 3,698,144 | 10/1972 | Stratton | 52/157 X |
| 4,106,879 | 8/1978 | Diedershagan et al. | 40/608 |
| 4,565,466 | 1/1986 | Daggs et al. | 40/608 X |
| 4,792,088 | 12/1988 | Bonnell . | |

*Primary Examiner*—Dennis L. Taylor
*Attorney, Agent, or Firm*—Barnes & Thornburg

[57] ABSTRACT

A post for supporting a mailbox or the like having an anchor engaging the ground and having an upper end, an enclosure having a plurality of vertical corner-defining members spaced from each other and including a vertical slot confronting the nearest adjacent corner-defining members and panels members situated between the corner-defining members, brackets fixed to at least some of the members of the enclosure within the intermediate portion for maintaining the relative position of the members, and a spring coupling a lower bracket to the anchor for biasing the lower ends of the vertical members toward the ground to support the enclosure in an upright position.

26 Claims, 1 Drawing Sheet

FIG. 1
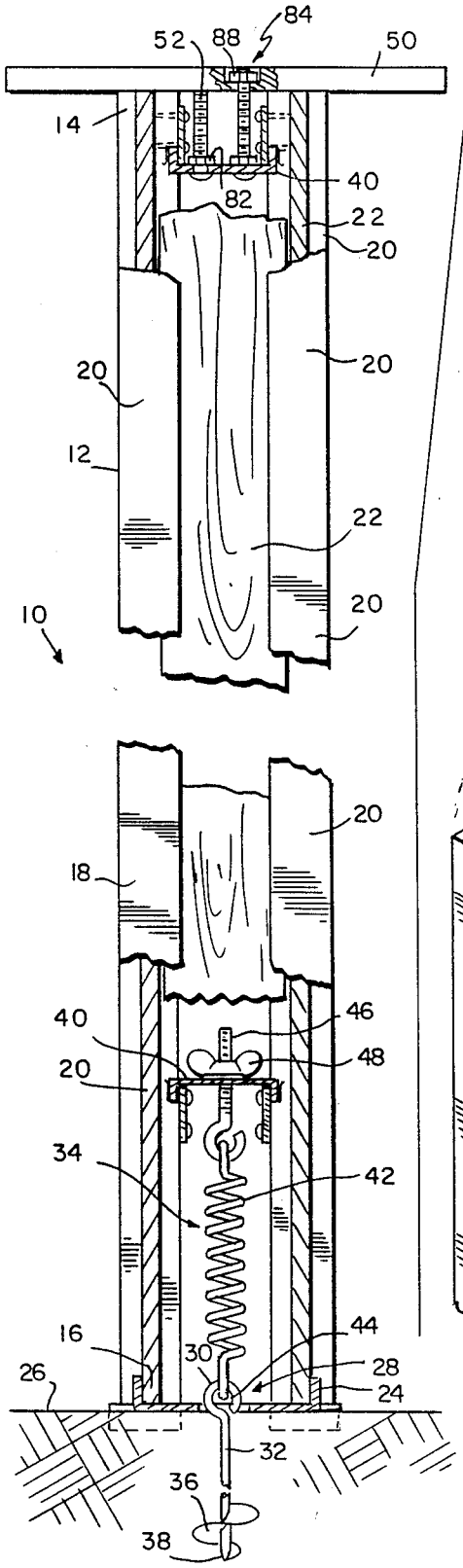
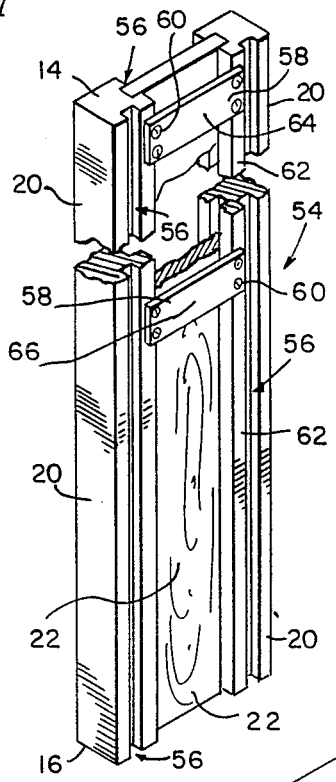
FIG. 2
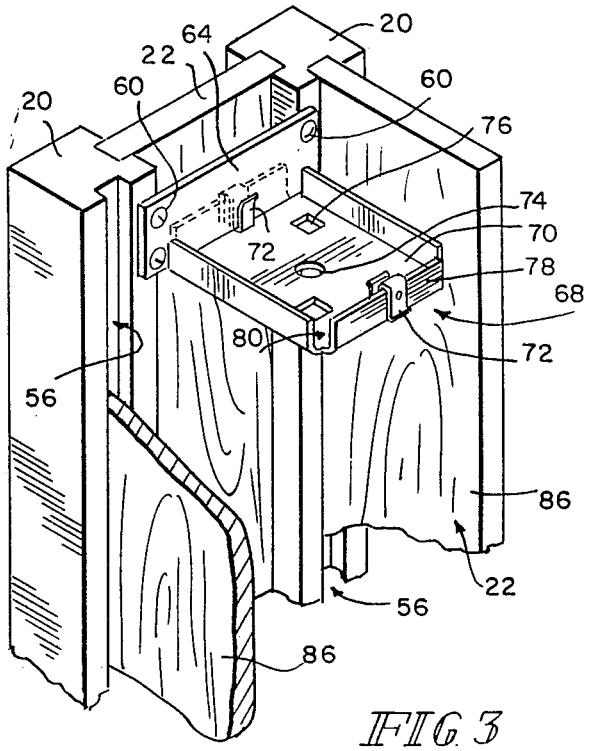
FIG. 3

SPRING SUPPORTED MAILBOX POST

BACKGROUND OF THE INVENTION

This invention relates generally to supports and more particularly to supports in the nature of a post which include apparatus to permit the post to withstand and to recover from a lateral force such as an impact by an automobile or the like.

A number of other inventors have addressed the problem of creating post-type supports or standards which are adapted to withstand and to recover from impact, whether due to an automobile, vandals, high winds, or other external sources. It has been recognized that a resilient spring section provided in such a post-type support permits the support to yield to such an outside force yet rebound to its original erect position once the force is removed. Such post-type supports have found use in connection with mailboxes, parking meters, traffic signs, and the like.

The post-type supports of the prior art, while dealing adequately with the problem of withstanding and recovering from destructive forces have failed to consider the desirability of constructing such a post so as to present a pleasing exterior consistent with the surrounding environment. There has also been little consideration given to constructing such a post which is environmentally compatible yet be simple to assemble by a "do-it-yourself" homeowner or the like.

SUMMARY OF THE INVENTION

In accordance with the present invention, a post for supporting a mailbox or the like comprises an enclosure constructed of a plurality of vertical members including corner-defining members and panel members situated between the corner-defining members. Bracket means are fixed to at least some of the corner-defining members so as to maintain the relative position of the members. Anchor means is provided for engaging the ground and a lower end of the enclosure is situated around the upper end of the anchor means. A biasing means in the form of a spring couples the bracket means to the anchor means. A mounting board is situated across the upper end of the members of the enclosure and is coupled to the bracket means, the mounting board being provided to receive a mailbox, sign, or other objects sought to be supported thereby.

In a preferred embodiment, the post of the present invention is provided in kit form including a pair of side assemblies, each assembly comprising a pair of elongated corner members, a rectangular panel member fixed between the corner members and bracing means fixed to the corner members for bracing each side assembly. Connecting means is provided for connecting the bracing means of one side assembly to the bracing means of another side assembly. The bracing means is adapted to be coupled to an anchor by a spring-biasing means. A mounting board is provided together with means for fastening the mounting board to the connecting means at one end of the pair of side assemblies. The kit includes at least one pair of additional side panels for joining the pair of side assemblies in spaced relation to each other so as to enclose the connecting means and coupling means. The side panels can be of various composition so as to provide the kit purchaser with decorative options.

One feature of the present invention is the use of an auger type anchor which can easily be installed in the ground without the use of a shovel or other digging implement. This feature has the advantage of permitting a "do-it-yourselfer" to install a post of the present construction without having to obtain additional tools and supplies prior to installation of the post.

Another feature of the present invention is the use of bracket means of common design for coupling the enclosure portion of the post to the spring biasing means and to the mounting board situated across the upper end of the members. A common bracing means is also used throughout the apparatus. This feature has the advantage of reducing the number of different parts actually employed in the construction of such a post thereby lowering inventory and design costs.

An additional feature of the present invention is the use of side panels for joining the side assemblies in relationship to each other which are slidably received in slots provided in the elongated corner members. The side panels can be of various construction including wood, metal, plastic, etc. This feature has the advantage of providing the "do-it-yourselfer" with a wide variety of choices for the appearance of the post-type support. It also permits replacement of the side panels at any time, for example, on the occasion of special seasons, holidays, etc.

Additional features and advantages of the invention will become apparent to those skilled in the art upon consideration of the following detailed description of preferred embodiments exemplifying the best mode of carrying out the invention as presently perceived. The detailed description particularly refers to the accompanying figures.

BRIEF DESCRIPTION OF THE DRAWINGS

FIG. 1 is a side elevation view partially broken away showing a post in accordance with this invention fully assembled.

FIG. 2 is a perspective view of a side assembly intended for use in a kit for the construction of a post in accordance with the present invention.

FIG. 3 is a detailed perspective view of the top portion of the post partially broken away to reveal the installation of the upper bracket.

DESCRIPTION OF THE PREFERRED EMBODIMENT

A supporting post 10 according to the present invention is shown in FIG. 1 to include an enclosure 12 having an upper end 14, a lower end, and an intermediate portion 18. The enclosure 12 is formed from a plurality of cornered defining members 20 which are spaced from each other by rectangular panel members 22. A base plate 24 is provided at the lower end 16 of the enclosure 12 and rests upon the underlying ground 26. The base plate 24 is shown to include a central opening 28. An upper end 30 of anchor means 32 projects through the opening of base plate 24 into the space 34 enclosed by enclosure 12.

The anchor means 32 is illustrated to comprise an auger 36 which can be screwed into the ground 26 so that the lower end 38 of the anchor means is firmly engaged in stable soil well below the surface of ground 26. It will be appreciated that the length of the anchor means 32 and its configuration are subject to variation and may depend on many variables including soil composition, wetness, etc.

A bracket means 40 is fixed to the interior of an intermediate portion 18 of enclosure 12. A biasing means 42 in the form of a spring is coupled to the eye 44 on the upper end 30 of the anchor 32. The spring 42 is also coupled to an adjustable coupling means 46 in the form of a threaded eye-bolt which penetrates the bracket means 40. A wing nut 48 permits adjustment of the tension in spring 42 so as to enhance the force applied by the spring to retain the post 10 in an upright position.

An additional bracket means 40 is provided at the upper end 14 of the enclosure. A mounting board 50 is situated across the upper end 14 of the enclosure, and coupling means in the form of stove bolts 52 are provided for coupling the mounting board 50 to bracket 40. It will be appreciated that the mounting board can be used as a supporting surface for a mailbox, a lamp, a sign, or other apparatus sought to be supported on a support in accordance with the present invention. It will further be appreciated that the mounting board can, in the appropriate circumstance, be integral with the apparatus mounted to the upper end 14 of the post 10.

In the preferred embodiment of the present invention, the materials for constructing a post as illustrated in FIG. 1 can be partially preassembled so as to be sold in kit form for a do-it-yourself construction using the minimum of tools. A pair of side assemblies 54 as shown in FIG. 2 are included in such a kit. Each side assembly 54 comprises two elongated corner defining members 20. The elongated defining members 20 include longitudinal slots 56. A rectangular panel member 22 is fixed with its longitudinal outer edges received in the confronting slots of the two corner members. The panel member 22 is preferably fixed in this position by nailing, bonding, or other equivalent means. Bracing means 58 are provided in the form of stretcher plates which are secured by fasteners 60 to a margin 62 inside slots 56 of corner members 20. The upper stretcher plate 64 is situated adjacent end 14 of the side assembly 54 while lower stretcher plate 66 is situated at an intermediate or mid portion 18 of the side assembly 54.

A connecting means 68 is provided for connecting the bracing means on one side assembly to the bracing means on the other side assembly. The connecting means 68 is shown in FIG. 3 to comprise bridging plate 70 and clips 72 which clip the bridging plate 70 to the stretcher plate 64. The bracing means 58 and connecting means 68 taken together form the bracket means 40 shown in FIG. 1.

The bridging plate 70 is shown in FIG. 3 to include a central round opening 74 and a pair of offset square openings 76. The bridging plate 70 also includes upstanding edges 78 which are separated from each other by corner notches 80. The stretcher plates 64 are shown to be received in a pair of corner notches 80 so that one of the upstanding edges 78 of the bridging plate 70 is positioned between the stretcher plate 64 and the adjacent panel member 22. The clip 72 clips upstanding edge 78 of the bridging plate 70 to stretcher plate 64.

The central round opening 74 in bridging plate 70 is used to receive the eye-bolt 46 as shown in FIG. 1. The square offset openings 76 are used to receive the bolts 52 as shown in FIG. 1. The bolts 52 are retained in position by retainers 82 in the form of nuts or clips which engage the bolts 52 and the upper surface of bridging plate 70.

To assemble a post in accordance with the present invention from a kit as previously described, the anchor means 32 is firmly installed in ground 26 at the desired location so that an upper end 30 protrudes slightly above the surface of ground 26. A base plate 24 is then situated on the ground so that the upper end 30 of anchor 32 protrudes through opening 28. The two side assemblies 54 are situated on base plate 24 such that the upper stretcher plates 64 are in a confronting relationship as are the lower stretcher plates 66. A bridging plate 70 is then inserted over the lower stretcher plates 66. The spring means 42 is coupled to eye 44 of the anchor upper end 30 and to the adjustable eye bolt 46. The upper end of the eye bolt 46 is passed through the central round opening 74 of the bridging plate 70 a distance sufficient to permit wing nut 48 to engage the threads of bolt 46. The wing nut 46 is then tightened so as to apply the desired pressure to the post 10. Another bridging plate 70 including the bolts 52 and retainers 82 is clipped to the upper stretcher plates so that the upper ends 84 of bolt 52 project beyond the upper end 14 of the side assemblies 54. A pair of side panels 86 are then slidably received downward from the top 14 in confronting slots 56 of the two adjacent side assemblies to complete the enclosure 12 except for an upward facing opening. The mounting board 50 is then positioned on the top 14 of the post so as to receive the upper ends 84 of bolts 52 which, together with fasteners such as nuts 88, act to secure the mounting board 50.

Once the post is so assembled, any lateral force on an upper portion of the post will cause the post to pivot about a lower edge 16 while the spring means 42 will act to ensure that the post will return to an upright position when the lateral force is removed. To change the side panels 86, the mounting board 50 is merely temporarily removed by disengaging fasteners 88 thereby permitting the side panels 86 to be slidably removed and replaced with other side panels. The mounting board 50 can then be reinstalled as before.

While the invention has been described in detail with reference to the illustrated preferred embodiment, variations and modifications exist within the scope and spirit of the invention as described. For example, the side assembly 54 is illustrated in FIG. 2 to comprise three separate elements, namely, the two corner members 20 and the intermediate panel member 22. These three members can be replaced by a unitary extruded plastic or aluminum member of the same general cross section and including slots 56. Appropriate bracing means 58 can be coupled to such an extruded member so as to form a side assembly substantially as shown. Additional variations and modifications within the scope and spirit of the invention as defined in the following claims will be apparent to those skilled in the art.

What is claimed is:

1. A post for supporting a mailbox, or the like, comprising:

anchor means for engaging the ground including an upper end, an enclosure comprising a plurality of vertical corner-defining members spaced from each other and including a vertical slot confronting the nearest adjacent corner-defining members, a plurality of panel members situated between the corner-defining members, each of the panel members having edges received in the slots of adjacent pairs of corner-defining members, the members having lower ends situated around the anchor means, upper ends above the lower ends, and an intermediate portion, bracket means fixed to at least some of the members of the enclosure within the intermediate portion for maintaining the relative position of the members, and biasing means coupling the bracket means to the anchor means for biasing the lower ends of the vertical members toward the ground to support the enclosure in an upright position.

2. The post of claim 1 wherein the anchor means comprises an auger having a lower poriton screwed into the ground, the upper end having means for engaging the biasing means.

3. The post of claim 1 wherein the bracket means is fixed only to the corner-defining members.

4. The post of claim 1 wherein the bracket means comprises a plurality of stretcher plates, each stretcher plate coupling a pair of the vertical members to each other, and a bridging plate connected to the stretcher plates and to the biasing means.

5. The post of claim 4 wherein the bridging plate includes a centrally situated opening, and the biasing means comprises means for adjustably coupling an upper end of the biasing means to the bridging plate through the opening.

6. The post of claim 1 wherein the biasing means comprises adjustable means for adjustably coupling an upper end thereof to the bracket means.

7. The post of claim 6 wherein the adjustable means comprises a bolt coupled to an upper end of the biasing means having an end projecting through the bracket means and a nut engaging the bolt at an adjustable position.

8. The post of claim 1 further comprising an upper bracket means fixed adjacent to the upper ends of at least some of said members of the enclosure for maintaining the relative position of the upper ends of the members.

9. The post of claim 8 wherein the upper bracket means comprises a plurality of stretcher plates, each stretcher plate coupling a pair of the vertical members to each other, a bridging plate, and clip means coupling the bridging plate to the stretcher plates.

10. The post of claim 8 further comprising a mounting board situated across the upper ends of said members of the enclosure, and means coupling the mounting board to the upper bracket means.

11. The post of claim 1 further comprising a base plate situated between the ground and the enclosure lower end, and surrounding the anchor means.

12. A post for supporting a mailbox, or the like, comprising:

a plurality of vertical corner-defining members spaced from each other, the members having adjacent lower ends, intermediate portions, adjacent upper ends above the lower ends, and vertical slots confronting the nearest adjacent corner-defining members, a plurality of panel members situated between the corner-defining members, each of the panel members having edges received in the slots of adjacent pairs of corner-defining members, and bracket means fixed to at least some of the corner-defining members for maintaining the relative position of the members.

13. The post of claim 12 further comprising biasing means coupled to the bracket means for biasing the lower ends of the vertical members downward to support the enclosure in an upright position.

14. The post of claim 12 further comprising anchor means engaging the ground for coupling the members to the ground.

15. The post of claim 12 wherein the bracket means comprises a plurality of bracing means fixed to adjacent pairs of the corner members for bracing each side of the post, and connecting means for connecting adjacent bracing means.

16. The post of claim 12 wherein the bracket means comprises upper bracket means fixed adjacent to the upper ends of at least some of the corner-defining members for maintaining the relative position of the upper ends of the members.

17. The post of claim 16 wherein the upper bracket means comprises a plurality of stretcher plates, each stretcher plate coupling a pair of the vertical members to each other, a bridging plate, and clip means coupling the bridging plate to the stretcher plates.

18. The post of claim 12 further comprising a mounting board situated across the upper ends of said members, and means coupling the mounting board to the upper bracket means.

19. The post of claim 12 further comprising a base plate situated between the ground and the lower ends of said members.

20. A kit for the construction of a mailbox post, or the like, comprising a plurality of vertical corner-defining members spaced from each other, the members having adjacent lower ends, intermediate portions, adjacent upper ends above the lower ends, and vertical slots confronting the nearest adjacent corner-defining members, a plurality of panel members situated between the corner-defining members, each of the panel members having edges received in the slots of adjacent pairs of corner-defining members, and bracket means fixed to at least some of the corner-defining members for maintaining the relative position of the members, the kit comprising:

a pair of side assemblies, each assembly comprising a pair of elongated corner members, a rectangular panel member fixed between the corner members, and bracing means fixed to the corner members for bracing each side assembly, connecting means for connecting the bracing means of one side assembly to the bracing means of the other side assembly, at least two additional rectangular panel members adapted to be received between the pair of side assemblies, an anchor, and coupling means for coupling the anchor to the connecting means.

21. The kit of claim 20 further comprising a pair of side panels for joining the pair of side assemblies in spaced relation to each other to enclose the connecting means and coupling means.

22. The kit of claim 21 further comprising at least one additional pair of side panels having a composition varying from said a pair of side panels.

23. The kit of claim 21 further comprising a mounting board, and means for fastening the mounting board to the connecting means at one end of the pair of side assemblies.

24. The kit of claim 20 wherein the coupling means comprises a spring, means for coupling the spring to the anchor and means for adjustably fastening the spring to the connecting means.

25. The kit of claim 20 wherein the connecting means comprises a bridging plate and clip means for clipping the bridging plate to the bracing means.

26. A kit for the construction of a mailbox post, or the like, comprising a plurality of vertical corner-defining members spaced from each other, the members having adjacent lower ends, intermediate portions, adjacent upper ends above the lower ends, and vertical slots confronting the nearest adjacent corner-defining members, a plurality of panel members situated between the corner-defining members, each of the panel members having edges received in the slots of adjacent pairs of corner-defining members, and bracket means fixed to at least some of the corner-defining members for maintaining the relative position of the members, the kit comprising:

a pair of side assemblies, each assembly comprising a pair of elongated corner members, a rectangular panel member fixed between the corner members, and bracing means fixed to the corner members for bracing each side assembly, connecting means for connecting the bracing means of one side assembly to the bracing means of the other side assembly, a pair of side panels for joining the pair of side assemblies in spaced relation to each other to enclose the connecting means, a mounting board, and means for fastening the mounting board to the connecting means at a first end of the pair of side assemblies, and coupling means for coupling the connecting means to the ground an a second end of the pair of side assemblies.

* * * * *